United States Patent [19]

Ashton

[11] Patent Number: 4,888,888

[45] Date of Patent: Dec. 26, 1989

[54] SOLE PROTECTORS FOR SHOES

[76] Inventor: Douglas W. Ashton, 3917 North Point Blvd., Baltimore, Md. 21222

[21] Appl. No.: 184,416

[22] Filed: Apr. 21, 1988

[51] Int. Cl.[4] ..... A43B 13/38; A43B 13/10; A43C 13/12

[52] U.S. Cl. ..... 36/43; 36/44; 36/73; 36/107

[58] Field of Search ..... 36/43, 44, 107, 108, 36/7.5, 7.6, 117, 25 R, 72 R, 73, 33; 128/586, 587; 198/582, 583

[56] References Cited

U.S. PATENT DOCUMENTS

| | | | |
|---|---|---|---|
| 518,923 | 4/1894 | Kilgore | 36/73 |
| 1,205,983 | 11/1916 | Emmerth | 36/7.5 |
| 1,676,170 | 7/1928 | Troiel | 36/73 X |
| 1,701,611 | 2/1929 | Glidden et al. | 36/44 X |
| 1,704,187 | 3/1929 | Glidden et al. | 36/44 X |
| 2,460,838 | 2/1949 | Margolin | 36/33 |
| 2,920,008 | 1/1960 | Frieder et al. | 36/44 X |
| 3,464,127 | 9/1969 | Muncie | 36/7.6 |
| 3,557,931 | 1/1971 | Fenandez | 198/582 X |
| 3,999,558 | 12/1976 | Barnwell et al. | 128/586 |

FOREIGN PATENT DOCUMENTS

| | | | |
|---|---|---|---|
| 1118594 | 2/1982 | Canada | 36/25 R |
| 315083 | 10/1919 | Fed. Rep. of Germany | 36/73 |
| 3318181 | 11/1984 | Fed. Rep. of Germany | 36/25 R |
| 2478441 | 9/1981 | France | 36/117 |
| 2572260 | 5/1986 | France | 36/72 R |
| 1130380 | 10/1968 | United Kingdom | 36/44 |

*Primary Examiner*—James Kee Chi

*Attorney, Agent, or Firm*—Walter G. Finch

[57] ABSTRACT

This invention is for several preferred embodiments of sole protectors for use with shoes for protecting the feet of the user. In one embodiment of the invention, a sole protector is provided in the shape of a sole of a boot formed of impenetrable material encased in a protective coating of material. The material for forming the impenetrable sole protector can be puncture proof, metal, and woven. In the second embodiment of the sole protector, the sole protector is formed of similar material, but with the sole formed of two sections hinged together. Additionally, the sole protector is designed with an arch height of a standard boot.

6 Claims, 3 Drawing Sheets

SOLE PROTECTORS FOR SHOES

BACKGROUND AND SUMMARY OF THE INVENTION

This invention relates to sole structure for shoes, and more particularly to sole protectors for protecting the feet of users of shoes.

Over the years, there have been countless injuries, loss of money and time because persons and workman have accidentally driven and/or punctured points or other sharp objects into the sole of footwear and consequently injured the delicate feet.

Construction workers and many people in industry, business, and in athletics face this problem daily. The expense of buying a pair of boots or shoes which has adequate protection to the sole of a shoe is difficult and time consuming to locate. Many in the construction field have experienced this painful occurrence too many times already. Thus the reason for the development of these new protectors for shoe sales.

It is an object of this invention to provide sole protectors that are easy to use and which are economical to manufacture and install in shoes for operational use.

Another object of this invention is to provide sole protectors for shoes that provide the maximum protection for the users feet along with consideration for users comfort.

Still another object of this invention is to provide sole protectors of special design which have the flexibility and ability to be used in more than one pair of shoes and boots.

And another object of this invention is to provide unique sole protectors for use in safely protecting the feet of the user of shoes.

A further object of this invention is to provide unique sole protectors which will reduce the number of persons injured by stepping on pointed and sharp objects and damaging the feet of the user.

Still even another object of this invention is to provide sole protectors for shoes which are easy to maintain and repair.

And still even another object of this invention is to provide sole protectors for shoes.

This invention is for a new protective footwear insert. The insert is designed to protect the foot of the wearer against injury from nails and other objects which may puncture the sole of the footwear.

The inserts are contoured to fit within a particular size boot or shoe and may be removed from one pair for use in another pair of shoes. One possible design may be made of metal or other puncture proof material having a complete coat of resilient material on its entire surface for increased wearer comfort and corrosion protection. A hinge design is incorporated in this type to enable the insert to flex during normal walking.

Another method of manufacturing of the sole protector would be to use a watchband type material (steel chain mesh) also being puncture proof and completely coated with a resilient material. This sole protector has the added feature of being completely flexible. It is the puncture proof aspect of the sole protector that makes the idea a good one, and this can not be compromised.

Further objects and advantages of the invention will become more apparent in the light of the following description of the preferred embodiments.

DESCRIPTION OF THE PREFERRED EMBODIMENTS

Figure 1:
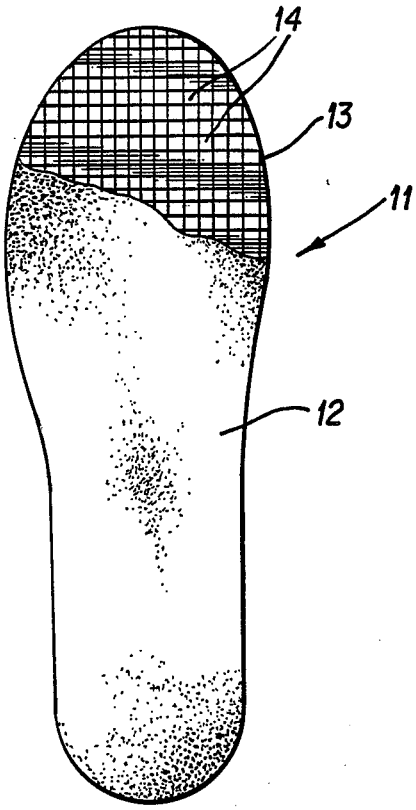
FIG. 1 is a plan view of a first embodiment of a sole protector for use with shoes.
Figure 2:
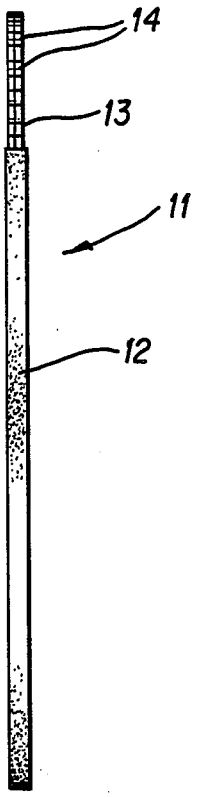
FIG. 2 is a side view of the first embodiment of a sole protector shown in FIG. 1.
Figure 3:
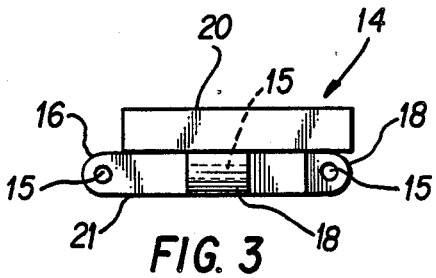
FIG. 3 is a side view of a section of puncture proof material of chain link or woven side for use in the sole protector of FIG. 1.
Figure 4:
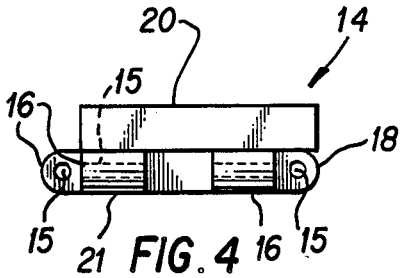
FIG. 4 is the opposite side view of the section of puncture proof material of FIG. 3.
Figure 5:
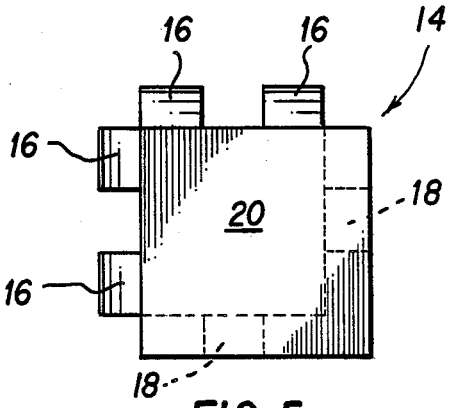
FIG. 5 is a top view of the section of puncture proof material of FIG. 3.
Figure 6:
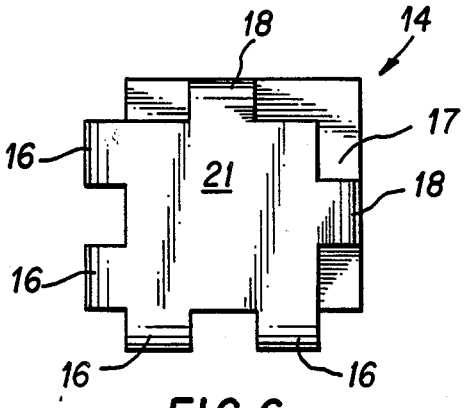
FIG. 6 is a bottom view of the section of puncture proof material of FIG. 3.

Referring now to FIGS. 1 and 2 of the first embodiment of the sole protector 11, there is shown a covered sole protector 12 having a part of the cover 13 removed to show the metal or other proof material of chain link or woven design section 14 for use as a barrier in the event the shoe of a user steps upon a sharp and/or pointed object, such as a nail or spike. This barrier of section 14 material prevents the spike or nail from passing through the sole protector 11, and this protects the feet of the person.

Figure 7:
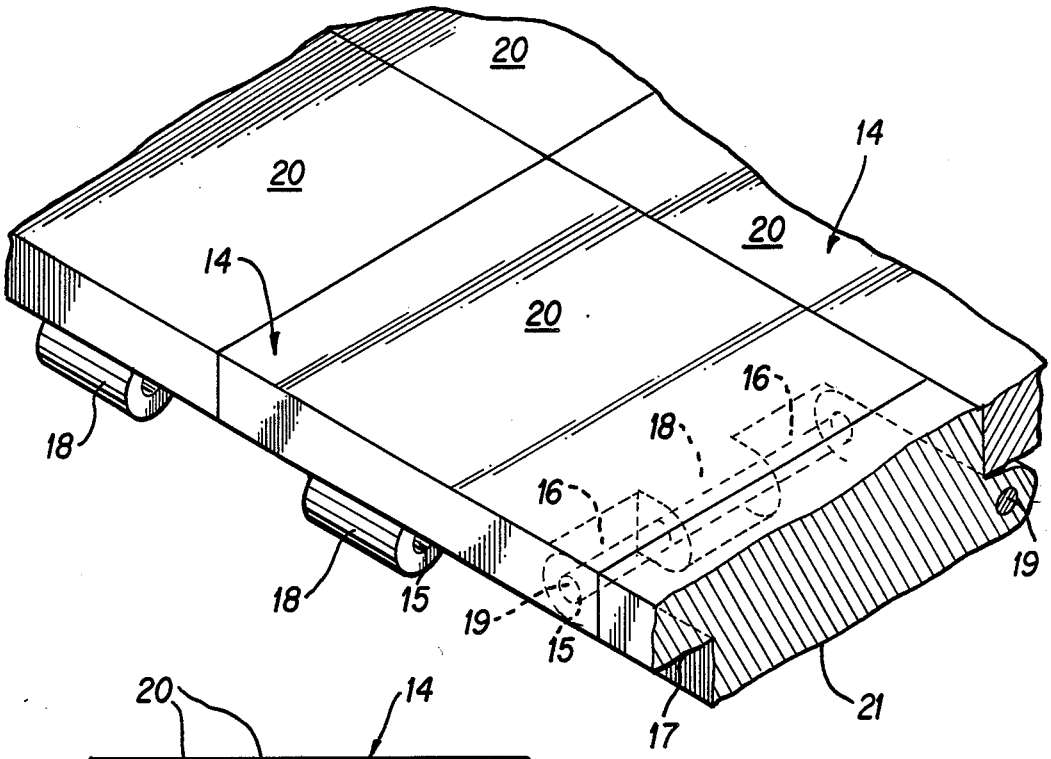
FIG. 7 is an enlarged perspective view, partially in cross section, of the sole protector of FIG. 1.
Figure 8:
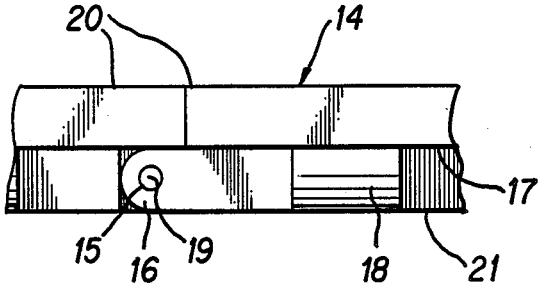
FIG. 8 is an enlarged side view of the sole protector of FIG. 7.

Referring now to FIGS. 3 to 6, there are illustrated representative sections 14, having upper and lower faces 20 and 21, of chain link or woven material 14, for forming the sole protector 11, which is made of a multiple of pieces linked together by hinges 16, 18, and hinge pins 19 located in apertures 15 as shown best in FIGS. 7 and 8.

The sole protectors 12 are used by placing or inserting them in a pair of shoes prior to putting the feet in the shoes.

Figure 9:
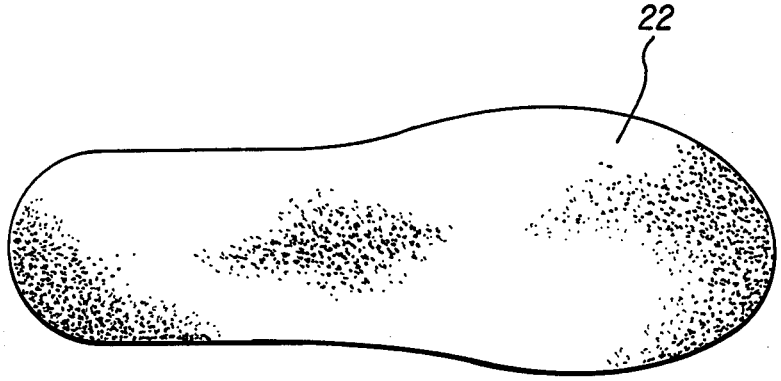
FIG. 9 is a plan view of a second embodiment of a sole protector.
Figure 11:
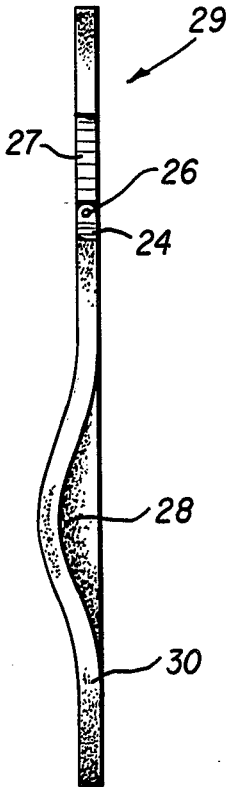
FIG. 11 is a side view of the second embodiment of the sole protector of FIGS. 9 and 10.
Figure 10:
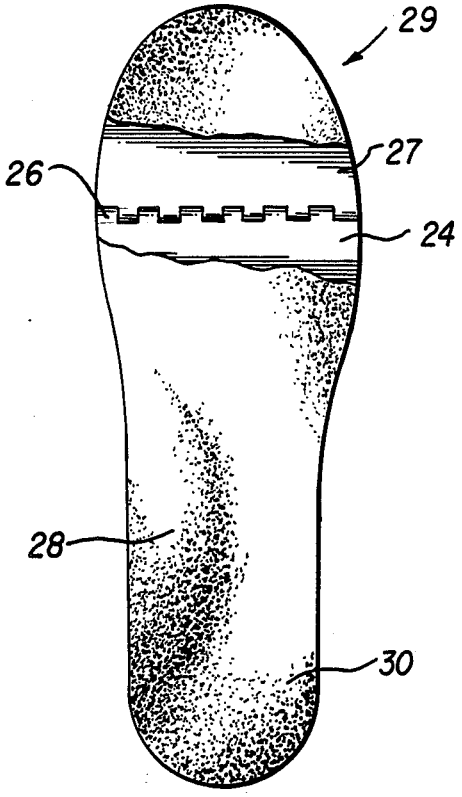
FIG. 10 is a plan view of the second embodiment of the sole protector showing parts removed to illustrate the hinge mechanism thereof.

Referring now to FIGS. 9, 10, and 11, there is shown a second embodiment of a sole protector 29, with the outside covered surface 22 being shown in FIG. 9, and the top and side views in FIGS. 10 and 11.

This second embodiment of the sole protector 29, consists of two sections 24 and 27 of metal or other puncture proof material of chain link or woven material design, covered by a suitable protective material coating 30. The two sections 24 and 27 are coupled together by a suitable pin 26, as shown best in FIGS. 10 and 11. The arch 28 is made of sufficient height to conform to the standard work boot.

As can be readily understood from the foregoing description of the invention, the present structure can be configured in different modes to provide sole protector for shoes.

Accordingly, modifications and variations to which the invention is susceptible may be practiced without departing from the scope and intent of the invention.

What is claimed is:

1. A sole protector for a shoe structure, comprising, a sole protector for a shoe structure formed in the shape of a shoe sole, said sole protector being formed of impenetrable material and encased in a protective coating of material, said sole protector being arranged in representative substantially square sections within the peripheral area of said sole protector, with non-square sections being arranged at the peripheral portion thereof to form the curvature of said sole protector, and hinge means for coupling said square and non-square sections together to form said sole protector.

2. A sole protector for a shoe structure as defined in claim 1, wherein said sole protector is formed of metallic material for protection of the foot.

3. A sole protector for a shoe structure as defined in claim 1, wherein said sole protector is formed of puncture proof material for protection of the foot.

4. A sole protector for a shoe structure as defined in claim 1, wherein said sole protector is formed of links for protection of the foot.

5. A sole protector for a shoe structure as defined in claim 1, wherein said sole protector is formed of a plurality of sections of sole hingely coupled together.

6. A sole protector for a shoe structure as defined in claim 1, wherein said sole protector is formed with a height of arch conforming to a conventional work boot.

* * * * *